US012637917B2

(12) United States Patent
Lenoir

(10) Patent No.: US 12,637,917 B2
(45) Date of Patent: May 26, 2026

(54) APPARATUS AND METHODS FOR OPERATING DOWNHOLE TOOLS

(71) Applicant: Wellbore Integrity Solutions LLC, Houston, TX (US)

(72) Inventor: Jacob Lenoir, Spring, TX (US)

(73) Assignee: Wellbore Integrity Solutions LLC, Houston, TX (US)

( * ) Notice: Subject to any disclaimer, the term of this patent is extended or adjusted under 35 U.S.C. 154(b) by 0 days.

(21) Appl. No.: 18/930,075

(22) Filed: Oct. 29, 2024

(65) Prior Publication Data

US 2026/0117612 A1 Apr. 30, 2026

(51) Int. Cl.
*E21B 23/04* (2006.01)
*E21B 34/06* (2006.01)

(52) U.S. Cl.
CPC ..... *E21B 23/0411* (2020.05); *E21B 34/063* (2013.01)

(58) Field of Classification Search
CPC ..... E21B 7/061; E21B 23/01; E21B 29/06; E21B 23/0411; E21B 23/042
See application file for complete search history.

(56) References Cited

U.S. PATENT DOCUMENTS 2,209,627 A * 7/1940 Miller ..... E21B 7/061 166/123
2,223,602 A * 12/1940 Cox ..... E21B 27/00 166/110
2,979,904 A * 4/1961 Royer ..... E21B 23/06 60/632
3,011,554 A 12/1961 Robert et al.
3,269,462 A 8/1966 Voetter
4,059,288 A * 11/1977 Mohr ..... E21B 43/0107 285/23
4,397,355 A * 8/1983 McLamore ..... E21B 7/061 166/117.6
4,768,594 A * 9/1988 Akkerman ..... E21B 34/08 166/65.1
5,154,231 A * 10/1992 Bailey ..... E21B 7/061 166/298
5,443,129 A * 8/1995 Bailey ..... E21B 21/103 175/45

(Continued)

FOREIGN PATENT DOCUMENTS

CN 110 578 487 A 12/2019

OTHER PUBLICATIONS

International Search Report and Written Opinion for PCT/US2025/052443 Dated Jan. 30, 2026.

*Primary Examiner* — Kipp C Wallace
(74) *Attorney, Agent, or Firm* — Patterson + Sheridan, LLP

(57) ABSTRACT

A tool assembly deployed in a wellbore with a running string includes a pressure booster sub. The booster sub is located between a first tool and a second tool. The first tool upstream of the booster sub is exposed to a relatively low pressure via the running string. The pressure booster sub is exposed to the relatively low pressure, and creates a relatively high pressure downstream of the booster sub. The second tool, downstream of the booster sub, is actuated by the relatively high pressure. The booster sub includes a piston. The piston includes a piston head with a first cross-sectional area, and a piston rod with a second cross-sectional area less than the first cross-sectional area.

19 Claims, 12 Drawing Sheets

(56) References Cited

U.S. PATENT DOCUMENTS

| | | | | |
|---|---|---|---|---|
| 6,050,334 | A | 4/2000 | McGarian et al. | |
| 6,073,708 | A | 6/2000 | Brown et al. | |
| 6,116,336 | A * | 9/2000 | Adkins | E21B 29/06 166/334.4 |
| 7,000,705 | B2 | 2/2006 | Buyers et al. | |
| 7,077,212 | B2 * | 7/2006 | Roesner | E21B 23/06 166/134 |
| 7,377,328 | B2 | 5/2008 | Dewey et al. | |
| 7,562,712 | B2 | 7/2009 | Cho et al. | |
| 7,814,978 | B2 | 10/2010 | Steele et al. | |
| 8,215,400 | B2 | 7/2012 | Roane et al. | |
| 8,844,620 | B2 | 9/2014 | Gregurek et al. | |
| 8,881,836 | B2 | 11/2014 | Ingram | |
| 8,978,766 | B2 * | 3/2015 | Nellessen, Jr. | F15B 1/08 166/344 |
| 9,151,136 | B2 * | 10/2015 | Ervin | E21B 17/06 |
| 9,316,077 | B2 | 4/2016 | Clemens et al. | |
| 9,347,268 | B2 * | 5/2016 | Grigor | E21B 7/061 |
| 9,540,919 | B2 | 1/2017 | Castillo et al. | |
| 11,441,375 | B2 | 9/2022 | Roane et al. | |
| 11,555,364 | B2 | 1/2023 | Mitchell | |
| 2002/0070015 | A1 * | 6/2002 | Armell | E21B 23/0416 166/383 |
| 2012/0298378 | A1 * | 11/2012 | McCauley | E21B 23/01 166/209 |
| 2016/0053559 | A1 * | 2/2016 | Alley | E21B 23/042 166/212 |

* cited by examiner

APPARATUS AND METHODS FOR OPERATING DOWNHOLE TOOLS

BACKGROUND

Field

Embodiments of the present disclosure generally relate to the operation of tools in a wellbore, and particularly to the operation of pressure-actuated tools in a wellbore.

Description of the Related Art

A tool may be installed in a wellbore in order to perform any one of a variety of tasks, such as sealing off a zone, suspending a liner, drilling a sidetrack, etc. Exemplary tools include packers, bridge plugs, liner hangers, whipstocks, or the like. Usually, a tool is fixed in position in a wellbore using an anchor. In some cases, the anchor is incorporated as part of the tool. In other cases, the anchor is coupled to the tool in an assembly before being run into the wellbore.

A typical anchor incorporates slips that include hardened teeth or buttons that are configured to embed into a wall of a wellbore casing. The slips are movable from a retracted position to an extended position. When the slips are in the retracted position, the anchor (and any tool coupled thereto) can be installed in a wellbore. When the slips are set (i.e., in the extended position), the teeth or buttons grip the casing to secure the anchor in position within the wellbore.

The slips of a typical anchor are actuated by applying pressure (known as a setting pressure) to the anchor. The pressure acts on a piston in the anchor to move the slips from the retracted position to the extended position. Usually, the anchor is configured such that the pressure applied to the anchor to initiate the setting of the slips must be greater than a predetermined threshold pressure. The predetermined threshold pressure is established in order to mitigate a risk of inadvertently setting the slips, such as due to a random pressure spike that may occur during the running of the anchor into the wellbore. Inadvertently setting the slips, such as while running the anchor into the wellbore, can result in the anchor and any tool attached thereto being set at too shallow a depth for the desired operation, or can result in a tool (such as a whipstock) being oriented incorrectly.

In some cases, the predetermined threshold pressure is similar to, or greater than, a maximum operating pressure of one or more other tools that may be run into the wellbore with the anchor. In an example, a drilling tool, such as a rotary steerable drilling tool may be run in tandem with a whipstock and an anchor, and the application of the setting pressure to the anchor incurs a risk of damage to the rotary steerable drilling tool. Alternatively, reducing the threshold pressure for setting the slips increases the risk of inadvertently setting the anchor at an inappropriate location of the wellbore.

Thus, there is a need for improved apparatus and processes that alleviate the above problems.

SUMMARY

The present disclosure concerns apparatus and methods for the operation of tools in a wellbore, and particularly relates to the operation of pressure-actuated tools in a wellbore. The systems, apparatus, and methods of the present disclosure facilitate operating one or more tools in a wellbore by applying a pressure, while alleviating the magnitude of pressure to which one or more other tools in the wellbore are exposed.

In one aspect, an assembly for use with a downhole tool includes an anchor. The anchor includes a first housing. An anchor element is coupled to the first housing, and is movable with respect to the first housing between a retracted position and an extended position. The assembly further includes a booster sub coupled to the anchor. The booster sub includes a second housing. A booster piston is disposed in the second housing. The booster piston isolates a first fluid in the anchor from a second fluid in the booster sub. When the anchor element is in the retracted position, the booster piston is movable relative to the second housing in a first direction and in an opposite second direction.

In another aspect, an assembly includes an anchor. The anchor includes a first housing containing a first fluid. An anchor element is coupled to the first housing, and is movable with respect to the first housing between a retracted position and an extended position. The assembly further includes a booster sub coupled to the anchor. The booster sub includes a second housing containing a second fluid. A booster piston is disposed in the second housing. The booster piston isolates the second fluid from the first fluid. The assembly further includes a whipstock coupled to the booster sub. The whipstock includes a hydraulic line containing the second fluid. The hydraulic line is fluidically coupled to the booster sub. The assembly further includes a running tool coupled to the whipstock. The running tool is fluidically coupled to the hydraulic line, and includes a third housing containing a third fluid. A barrier disposed in the third housing separates the third fluid from the second fluid.

In another aspect, a method of performing a downhole operation includes applying a first pressure to a barrier disposed in a housing of a running tool, thereby causing application of a second pressure to a booster piston disposed in a booster sub that is fluidically coupled to the running tool. The method further includes moving the booster piston relative to a housing of the booster sub by application of the second pressure. The method further includes applying a third pressure by the booster piston to an anchor coupled to the booster sub, thereby moving an anchor element of the anchor from a retracted position to an extended position.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of the scope of the disclosure, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure concerns apparatus and methods for the operation of tools in a wellbore, and particularly relates to the operation of pressure-actuated tools in a wellbore. The systems, apparatus, and methods of the present disclosure facilitate operating one or more tools in a wellbore by applying a pressure, while alleviating the magnitude of pressure to which one or more other tools in the wellbore are exposed.

Figure 1A:
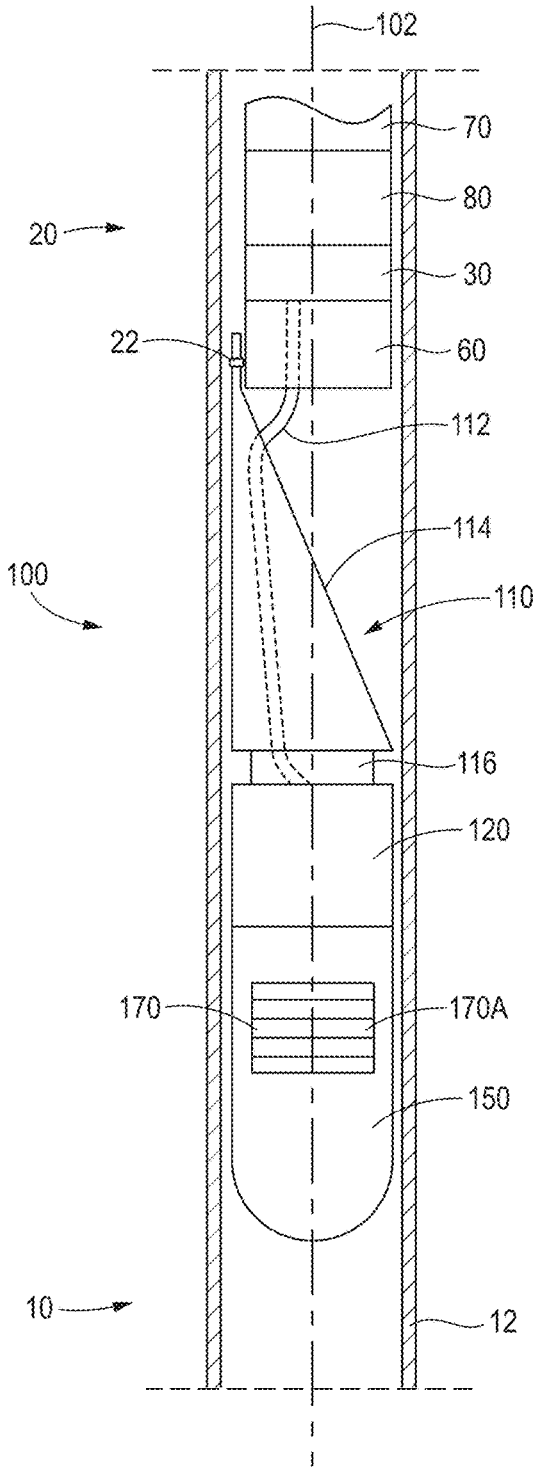
FIG. 1A schematically illustrates a tool assembly in a wellbore.

FIG. 1A schematically illustrates a tool assembly 100 in a wellbore 10. The wellbore 10 includes a casing 12 that represents a casing string extending from a wellhead (not shown) or a liner string that does not extend from a wellhead. In some embodiments, the wellbore 10 includes a section of uncased open hole. In some embodiments, the wellbore 10 does not include a section of uncased open hole.

The tool assembly 100 includes an anchor 150. The anchor 150 includes one or more anchor elements 170 that are movable with respect to a longitudinal axis 102 of the tool assembly 100 from a retracted position to an extended position. The one or more anchor elements 170 function to secure the anchor 150 within the wellbore 10 (such as within the casing 12 or within an uncased open hole section). As illustrated, the one or more anchor elements 170 include one or more slips 170A. In some embodiments, the anchor 150 includes a packing element in addition to the one or more slips 170A. In some embodiments, the anchor 150 does not include a packing element.

The anchor 150 is coupled to a booster sub 120. The booster sub 120 is coupled to a whipstock 110 such that the booster sub 120 is between the whipstock 110 and the anchor 150. In some embodiments, the whipstock 110 may be omitted.

The tool assembly 100 is coupled to a running string 20. As illustrated, in some embodiments, the whipstock 110 is coupled to the running string 20. In some embodiments in which the whipstock 110 is omitted, the booster sub 120 may be coupled directly to the running string 20. In some embodiments in which the whipstock 110 is omitted, the booster sub 120 may be coupled indirectly to the running string 20, such as via an intermediate tubular or another downhole tool.

In some embodiments in which the whipstock 110 is coupled to the running string 20, the whipstock is coupled directly to the running string 20. In some embodiments in which the whipstock 110 is coupled to the running string 20, the whipstock is coupled indirectly to the running string 20, such as via an adapter. In some embodiments, the whipstock 110 is coupled to the running string 20 by a bolt 22. As illustrated, the running string 20 includes a bit 60, such as a drill bit, a mill, or a mill-drill bit. The bolt 22 couples the bit 60 to the whipstock 110.

The running string 20 further includes a running tool 30 and a drilling system 80. In some embodiments, the drilling system 80 includes one or more stabilizers, such as a fixed gauge stabilizer or an adjustable stabilizer. In some embodiments, the drilling system 80 includes a drilling motor. In some embodiments, the drilling system 80 includes a bent sub. In some embodiments, the drilling system 80 is a directional drilling system. In some embodiments, the directional drilling system includes a stabilizer or a drilling motor or a bent sub. In some embodiments, the drilling system 80 is a rotary steerable drilling system, such as a "push-the-bit" rotary steerable system or a "point-the-bit" rotary steerable system. In some embodiments, the drilling system 80 may be omitted. In some embodiments, the bit 60 may be omitted, and the running tool 30 may be coupled to the whipstock 110 by the bolt 22. The running string 20 includes a tubular 70, such as drill pipe or coiled tubing, to convey the tool assembly 100 into the wellbore 10.

In some embodiments, one or more components of the running string 20 are operated at an internal pressure that is less than or equal to an internal pressure of the anchor 150 at which the one or more anchor elements 170 are actuated to move to the extended position. In some of such embodiments, the one or more components of the running string 20 present a maximum operating pressure limitation of the running string 20. In some examples that may be combined with other examples, the bit 60 presents the maximum operating pressure limitation of the running string 20. In some examples that may be combined with other examples, the running tool 30 presents the maximum operating pressure limitation of the running string 20. In some examples that may be combined with other examples, the drilling system 80 presents the maximum operating pressure limitation of the running string 20.

A hydraulic line 112 provides a fluidic coupling between the running string 20 and the booster sub 120. The hydraulic line 112 is routed through the whipstock 110 (such as behind a deflector plate 114 of the whipstock 110) to the booster sub 120. In some embodiments, the hydraulic line 112 is coupled to the running tool 30. In some embodiments, the hydraulic line 112 is coupled to the bit 60. In some examples, the hydraulic line 112 is fluidically coupled to the bit 60. In some examples, the hydraulic line 112 is fluidically coupled to the bit 60, and the bit 60 is fluidically coupled to the running tool 30. In some examples, the hydraulic line 112 is fluidically coupled to the bit 60, and the bit 60 includes the running tool 30.

In some embodiments, the hydraulic line 112 is routed through the bit 60, and is coupled to the running tool 30. In some examples, the hydraulic line 112 is fluidically coupled to the running tool 30. In some examples, the hydraulic line 112 is fluidically coupled to the running tool 30 and is fluidically coupled to the bit 60. In some examples, the bit 60 incorporates the running tool 30. In some examples, the hydraulic line 112 is fluidically coupled to the running tool 30, but is not fluidically coupled to the bit 60.

Figure 1B:
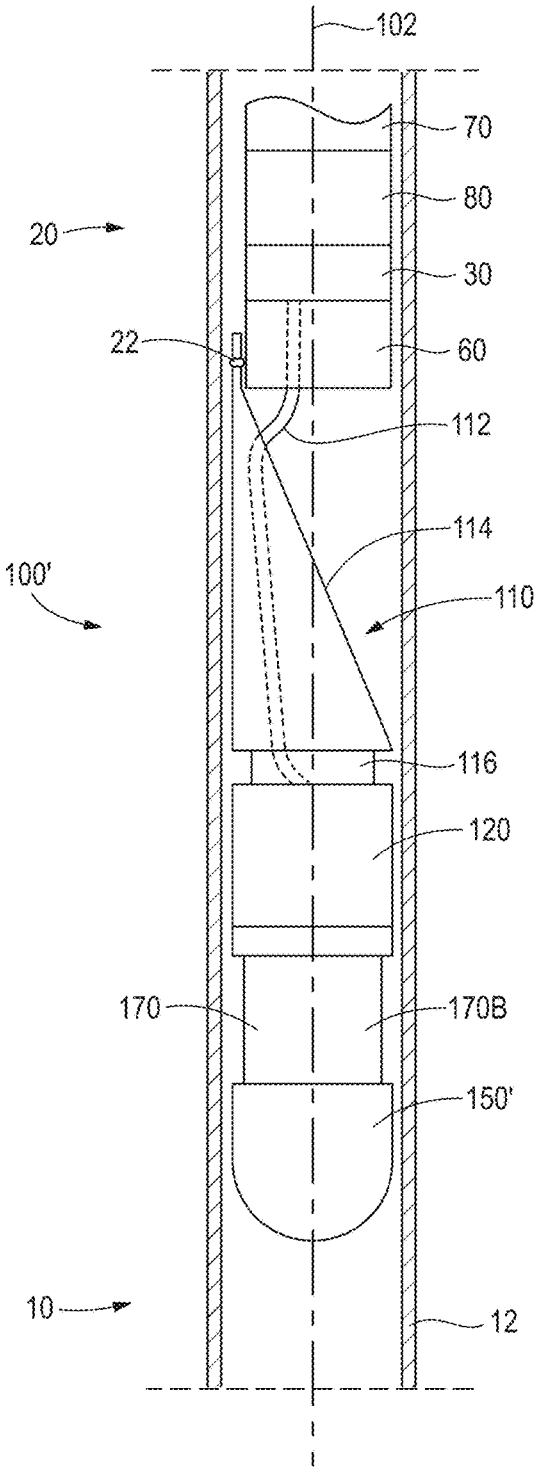
FIG. 1B schematically illustrates a tool assembly in a wellbore.

FIG. 1B schematically illustrates a tool assembly 100' in the wellbore 10. Tool assembly 100' is a variant of tool assembly 100 in which anchor 150 is replaced by anchor 150'. One or more anchor elements 170 of anchor 150' include a packing element 170B that is movable with respect to the longitudinal axis 102 of the tool assembly 100' from a retracted position to an extended position. The packing element 170B functions to secure the anchor 150' within the wellbore 10 (such as within the casing 12 or within an uncased open hole section).

In some embodiments, the packing element 170B includes an inflatable bladder. In some embodiments, the packing element 170B does not include an inflatable bladder. In some embodiments, the anchor 150' includes one or more slips (such as the one or more slips 170A) in addition to the packing element 170B. In some embodiments, the anchor 150' does not include one or more slips.

Other components of tool assembly 100' are as described above with respect to tool assembly 100.

In some embodiments, tool assembly 100 or tool assembly 100' is adapted to include one or more other downhole tools in addition to anchor 150 or anchor 150'. In some embodiments, tool assembly 100 or tool assembly 100' is adapted to include one or more other downhole tools instead of anchor 150 or anchor 150'. In some embodiments, the booster sub 120 is coupled to the running string 20 between the tubular 70 and one or more other downhole tools (such as a pressure-operated casing punch or perforator). In some examples, the whipstock 110 or the bit 60 may be omitted. In some embodiments, one or more components of the running string 20 are operated at an internal pressure that is less than or equal to an internal pressure of the one or more other downhole tools, such as described above.

Figure 2A:
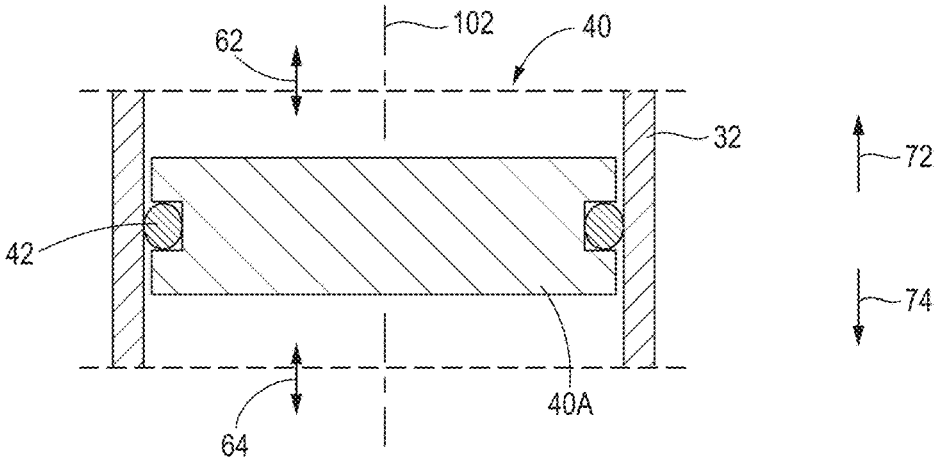
FIGS. 2A to 2C schematically illustrate exemplary configurations of a tool depicted in FIGS. 1A and 1B.
Figure 2B:
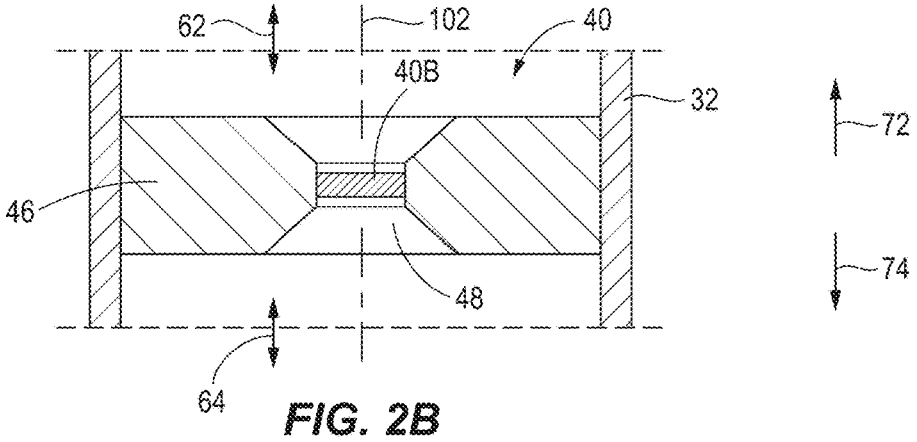
Figure 2C:
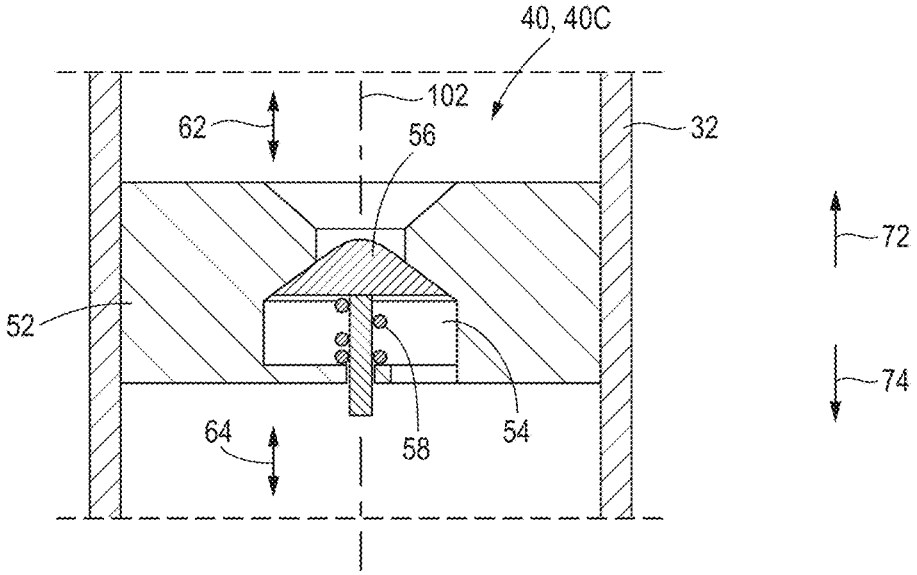

FIGS. 2A to 2C schematically illustrate exemplary configurations of the running tool 30. The running tool 30 includes a housing 32. A barrier 40 is disposed in the housing 32. A fluid (represented by double-headed arrow 62) is above the barrier 40, and a fluid (represented by double-headed arrow 64) is below the barrier 40. The barrier 40 separates the fluid 62 from the fluid 64. In some embodiments, the fluid 62 and the fluid 64 have the same composition. In other embodiments, the fluid 62 and the fluid 64 are of different compositions. In some examples, the fluid 62 includes a brine or a drilling mud, whereas the fluid 64 includes a hydraulic oil. In other examples, the fluid 62 includes a first brine (such as a formate brine), whereas the fluid 64 includes a second brine (such as a chloride brine).

In FIG. 2A, the barrier 40 is represented by a piston 40A. The piston 40A is movable longitudinally (e.g., along the longitudinal axis 102) with respect to the housing 32, and includes a seal 42 in contact with the housing 32. In some embodiments, the piston 40A is configured as a floating piston. In some examples, the piston 40A is able to move upwards (denoted by arrow 72, parallel to the longitudinal axis 102) in response to a pressure caused by thermal expansion of the fluid 64. In some examples, the piston 40A is able to move upwards 72 in response to a pressure (such as caused by thermal expansion of another fluid) that is communicated to the fluid 64.

In some embodiments, the piston 40A is restrained from moving upwards 72, such as by a shoulder or stop member of the housing 32. In some embodiments, the piston 40A is temporarily restrained from moving longitudinally—upwards 72 or downwards (denoted by arrow 74). Downwards 74 is parallel to longitudinal axis 102, and is opposite in direction to upwards 72. In some examples, the piston 40A is temporarily restrained by being fixed to the housing 32 by a shearable fastener, such as a shear pin. In such examples, the application of a pressure to the piston 40A that exceeds a predetermined threshold causes the shearable fastener to break, and permits the piston 40A to move with respect to the housing 32.

In FIG. 2B, the barrier 40 is represented by a rupture disc 40B. The rupture disc 40B is disposed in an opening 48 in a holder 46. The holder 46 is disposed in the housing 32. The rupture disc 40B provides a seal that separates the fluid 62 from the fluid 64. The application of a pressure to the rupture disc 40B that exceeds a predetermined threshold pressure causes the rupture disc 40B to fail, and permits the passage of fluids through the opening 48 of the holder 46. In some examples, the pressure to break the rupture disc 40B is applied to fluid 62. Upon the breaking of the rupture disc 40B, a portion of fluid 62 passes through the opening 48 and commingles with fluid 64.

In FIG. 2C, the barrier 40 is represented by a valve 40C, such as a poppet valve, a check valve, or a metering valve. The valve 40C includes a body 52 disposed in the housing 32. In some embodiments, an aperture 54 through the body 52 is obscured by a valve member 56. In some embodiments, the valve member 56 includes a flapper. As illustrated, in some embodiments, the valve member 56 includes a plunger. The valve member 56 is biased towards a sealing position against the body 52 by a biasing member 58, such as a spring. In some embodiments, the valve member 56 provides a seal against the body 52 that separates the fluid 62 from the fluid 64. The application of a pressure to the valve member 56 by the fluid 62 that exceeds a predetermined threshold pressure causes the valve member 56 to move away from the aperture 54 against the force of the biasing member 58, and permits the passage of fluids through the aperture 54. In some examples, a portion of fluid 62 passes through the aperture 54 and commingles with fluid 64.

Figure 3A:
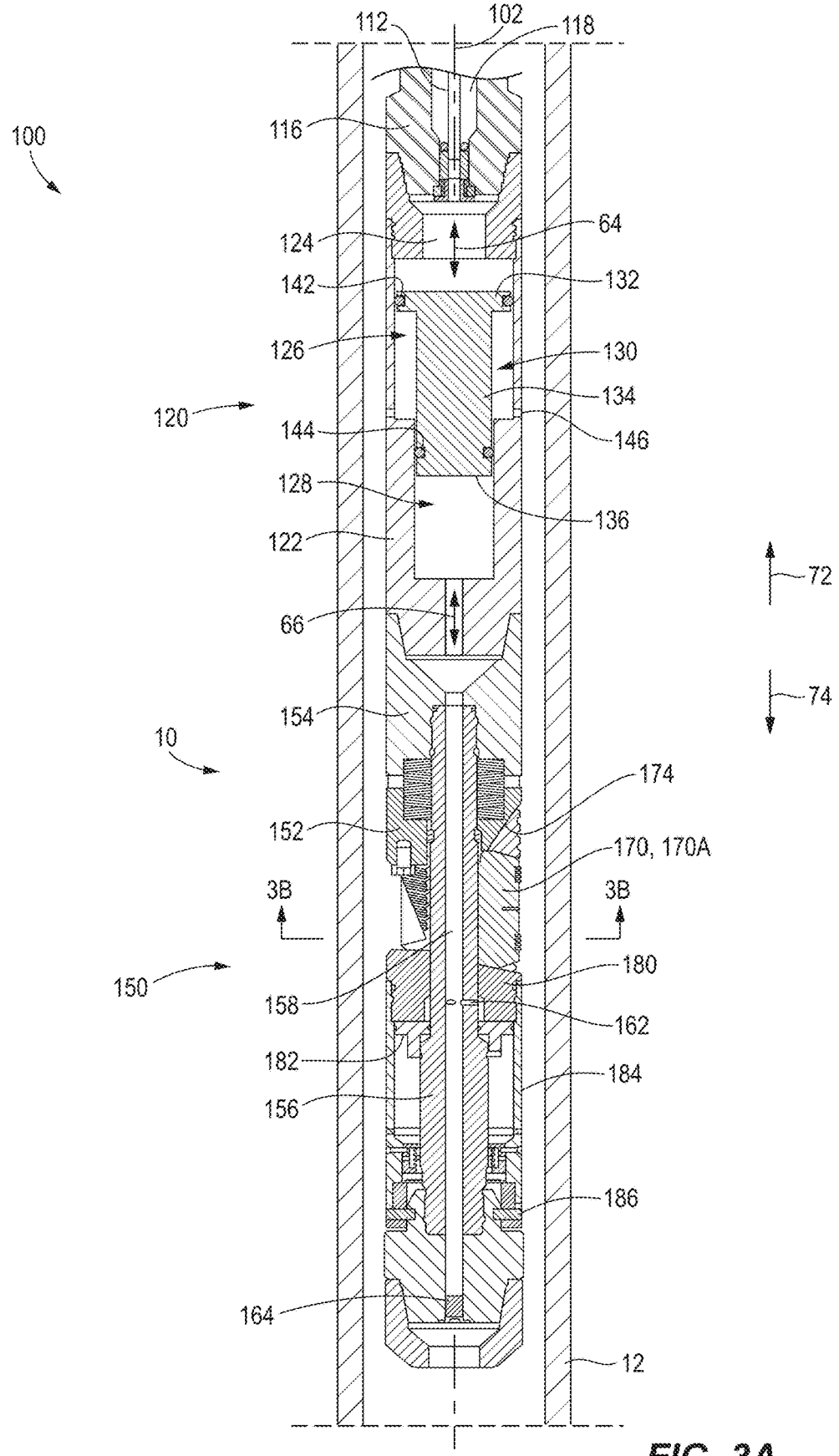
FIG. 3A schematically illustrates details of a portion of the tool assembly of FIG. 1A in a configuration in which the tool assembly is being run into the wellbore.

FIG. 3A schematically illustrates exemplary configurations of the booster sub 120 and anchor 150 of tool assembly 100 in a configuration in which the tool assembly 100 is being run into the wellbore 10. The booster sub 120 is coupled to a connector 116 (such as a threaded connector) of the whipstock 110. The hydraulic line 112 is disposed in a bore 118 of the connector 116, and is coupled to the connector 116. The hydraulic line 112 communicates the fluid 64 from the running string 20 to the booster sub 120.

The booster sub 120 includes a housing 122 with a bore 124 therethrough. The bore 124 runs longitudinally (e.g., along the longitudinal axis 102) through the housing 122. A piston 130 is disposed in the bore 124, and is movable longitudinally with respect to the housing 122. In some embodiments, the piston 130 is configured as a floating piston, and is able to move upwards 72 and downwards 74.

The piston 130 includes a piston head 132 coupled to a piston rod 134. The piston head 132 has an outer diameter that is greater than an outer diameter of the piston rod 134. The piston head 132 is disposed in a first portion 126 of the bore 124 having a first inner diameter, and includes a seal 142 in contact with a wall of the first portion 126 of the bore 124. The piston rod 134 is disposed in a second portion 128 of the bore 124 having a second inner diameter. The second inner diameter is smaller than the first inner diameter. The piston rod 134 includes a seal 144 in contact with a wall of the second portion 128 of the bore 124. The seal 144 is disposed proximal to an end 136 of the piston rod 134, distal from the piston head 132.

A cross-sectional area of the first portion 126 of the bore 124 is larger than a cross-sectional area of the second portion 128 of the bore 124. A cross-sectional area of the piston head 132 is larger than a cross-sectional area of the piston rod 134.

The piston 130 isolates the fluid 64 in the housing 122 above the piston head 132 from a fluid (represented by double-headed arrow 66) in the housing 122 below the piston rod 134. In some embodiments, the fluid 64 and the fluid 66 have the same composition. In other embodiments, the fluid 64 and the fluid 66 are of different compositions. In some examples, the fluid 64 includes one of a brine or a hydraulic oil, whereas the fluid 66 includes the other of a brine or a hydraulic oil. In other examples, the fluid 64 includes a first brine (such as a formate brine), whereas the fluid 66 includes a second brine (such as a chloride brine). In other examples, the fluid 64 includes a first hydraulic oil, whereas the fluid 66 includes a second hydraulic oil of a composition different to the first hydraulic oil.

In some embodiments, the fluid 62 and the fluid 66 have the same composition. In other embodiments, the fluid 62 and the fluid 66 are of different compositions. In some examples, the fluid 62 includes a brine or a drilling mud, whereas the fluid 66 includes a hydraulic oil. In other examples, the fluid 62 includes a first brine (such as a formate brine), whereas the fluid 66 includes a second brine (such as a chloride brine).

The piston 130 is configured such that there is no fluid communication through the piston 130 between the fluid 64 above the piston head 132 and the fluid 66 below the piston rod 134. As illustrated, in some embodiments, the piston 130 does not include a bore through the piston head 132 and the piston rod 134. In some embodiments, the piston 130 includes a bore through the piston head 132 and the piston rod 134. In some examples, the bore through the piston head 132 and the piston rod 134 is plugged, such as by a plug or stopper, or by a valve (such as a check valve, poppet valve, or metering valve).

One or more vents 146 in the housing 122 fluidically couple the bore 124 with an exterior of the housing 122. The one or more vents 146 are located between the piston head 132 and the seal 144 of the piston rod 134. As illustrated, in some embodiments, the one or more vents 146 intersect with the first portion 126 of the bore 124. In some embodiments, the one or more vents 146 intersect with the second portion 128 of the bore 124. The one or more vents 146 relieve a potential pressure lock in the bore 124 between the seal 142 of the piston head 132 and the seal 144 of the piston rod 134.

The booster sub 120 is coupled to a connector 154 (such as a threaded connector) of the anchor 150. The anchor 150 includes a mandrel 156 coupled to the connector 154. The mandrel 156 includes a bore 158 running longitudinally therethrough. In some embodiments, the bore 158 is sealed by a plug 164 at a location towards an end that is distal from the connector 154. The anchor 150 is in fluid communication with the booster sub 120 via the bore 158 in the mandrel 156 and the connector 154.

Figure 3B:
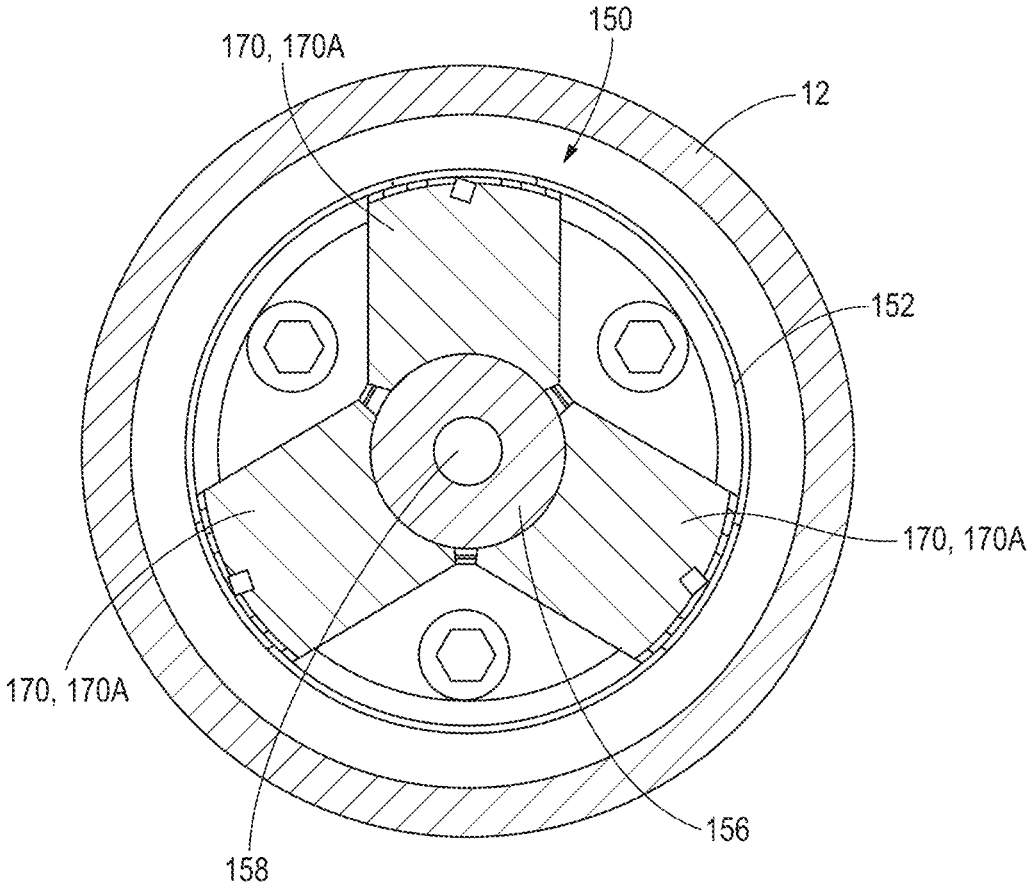
FIG. 3B schematically illustrates a lateral cross-section through one of the tools depicted in FIG. 3A.

A housing 152 is disposed about the mandrel 156. The one or more anchor elements 170 include one or more slips 170A. The one or more slips 170A are disposed in the housing 152. The one or more slips 170A are illustrated in the retracted position. FIG. 3B schematically illustrates a lateral cross-section through the anchor 150 at the one or more slips 170A. As illustrated, in some embodiments, the anchor 150 includes three slips 170A disposed about the mandrel 156. However, in other embodiments, the anchor 150 may include one, two, four, five, six, or more slips 170A.

Returning to FIG. 3A, the housing 152 includes one or more ramps 174. Each ramp 174 is disposed adjacent to a corresponding slip 170A of the one or more slips 170A. A piston 180 is disposed about the mandrel 156, and is movable longitudinally with respect to the mandrel 156 and with respect to the housing 152. The piston 180 is disposed adjacent each slip 170A of the one or more slips 170A. The piston 180 is disposed between each slip 170A of the one or more slips 170A and a stop member 182, such as a shoulder of the mandrel 156. A port 162 in the mandrel 156 provides fluidic communication between the bore 158 and the piston 180.

In some embodiments, the piston 180 is temporarily restrained from moving with respect to the mandrel 156 or with respect to the housing 152. In some examples, the piston 180 is coupled to a sleeve 184 that is coupled to the mandrel 156 by one or more frangible fasteners 186, such as shear pins.

In some embodiments, the booster sub 120 is configured to accommodate thermal expansion of the fluid 66 within the anchor 150 and within the booster sub 120. The thermal expansion may occur while running the tool assembly 100 into the wellbore 10. In some examples, the fluid 66 is contained within a trapped volume of the anchor 150 and the booster sub 120. The trapped volume is bounded by the piston 180, the stop member 182, the bore 158 of the mandrel 156, the connector 154, and the bore 124 of the booster sub 120 between the seal 144 of the piston rod 134 and the connector 154 of the anchor 150. In embodiments in which the piston 130 of the booster sub 120 is configured as a floating piston, the piston 130 facilitates the relief of at least a portion of an increase in pressure of the fluid 66 resulting from thermal expansion of the fluid 66. The piston 130 of the booster sub 120 moves upwards 72 in response to thermal expansion of the fluid 66. In some examples, the piston 130 of the booster sub 120 moves upwards 72 in response to thermal expansion of the fluid 66 while the one or more slips 170A are in the retracted position shown in FIGS. 3A and 3B.

In some embodiments, upward 72 movement of the piston 130 of the booster sub 120 and thermal expansion of the fluid 64 is accommodated at least in part by upward 72 movement of the piston 40A of the running tool 30. In some embodiments, upward 72 movement of the piston 130 of the booster sub 120 and thermal expansion of the fluid 64 is accommodated at least in part by a compensating piston (not shown) of the running tool 30.

In order to set the anchor 150 in the wellbore 10, the pressure of the fluid 62 in the running tool 30 is increased, such as by pumping fluid into the running string 20. In some embodiments, the pressure of the fluid 62 in the running tool 30 is increased to a magnitude that is less than or equal to a maximum operating pressure limitation of the running string 20. In embodiments in which the barrier 40 of the running tool 30 is represented by the piston 40A, the piston 40A communicates the pressure of the fluid 62 to the fluid 64. In embodiments in which the barrier 40 of the running tool 30 is represented by the rupture disc 40B, increasing the pressure of the fluid 62 beyond a threshold pressure breaks the rupture disc 40B, and a portion of fluid 62 passes through the opening 48 and communicates the pressure of the fluid 62 to the fluid 64. In embodiments in which the barrier 40 of the running tool 30 is represented by the valve 40C, increasing the pressure of the fluid 62 beyond a threshold pressure opens the valve 40C, and a portion of fluid 62 passes through the aperture 54 and communicates the pressure of the fluid 62 to the fluid 64. Maintaining, or increasing, the pressure of the fluid 62 concomitantly increases the pressure of the fluid 64.

The increased pressure of the fluid 64 is communicated via the hydraulic line 112 to the booster sub 120. The pressure of the fluid 64 acts on the piston head 132 of the piston 130. The piston 130 communicates pressure to the fluid 66 via the piston rod 134. The pressure applied by the piston rod 134 to the fluid 66 is greater than the pressure exerted by the fluid 64 on the piston head 132. The greater pressure applied by the piston rod 134 to the fluid 66 results from the larger cross-sectional area of the first portion 126 of the bore 124 containing the piston head 132 compared to the cross-sectional area of the second portion 128 of the bore 124 containing the piston rod 134. A pressure of the fluid 66 in the anchor 150 is increased by application of the pressure applied by the piston rod 134 to the fluid 66 in the booster sub 120.

A net force of the fluid 66 on the piston 180 of the anchor 150 is transmitted via the sleeve 184 to the one or more frangible fasteners 186. When the pressure of the fluid 66 is raised beyond a predetermined threshold pressure, the force transmitted via the sleeve 184 breaks the one or more frangible fasteners 186. The sleeve 184 and the piston 180 are thereby released to move along the mandrel 156. The pressure of the fluid 64 causes the piston 130 of the booster sub 120 to move downwards 74 with respect to the housing 122. The piston 130 moves a portion of the fluid 66 from the booster sub 120 into the anchor 150. The fluid 66 in the anchor 150 pushes the piston 180 along the mandrel 156 in the upwards direction 72. The piston 180 pushes each of the one or more slips 170A along each corresponding ramp 174, and each of the one or more slips 170A moves radially outwardly away from the mandrel 156, the housing 152, and the longitudinal axis 102. Each of the one or more slips 170A moves radially outwardly away from the mandrel 156, the housing 152, and the longitudinal axis 102 towards an extended position (shown in FIGS. 4A and 4B, below). In some embodiments, the anchor 150 is configured such that the piston 180 moves downwards 74 to cause the one or more slips 170A to move radially outwardly away from the mandrel 156, the housing 152, and the longitudinal axis 102.

Figure 3C:
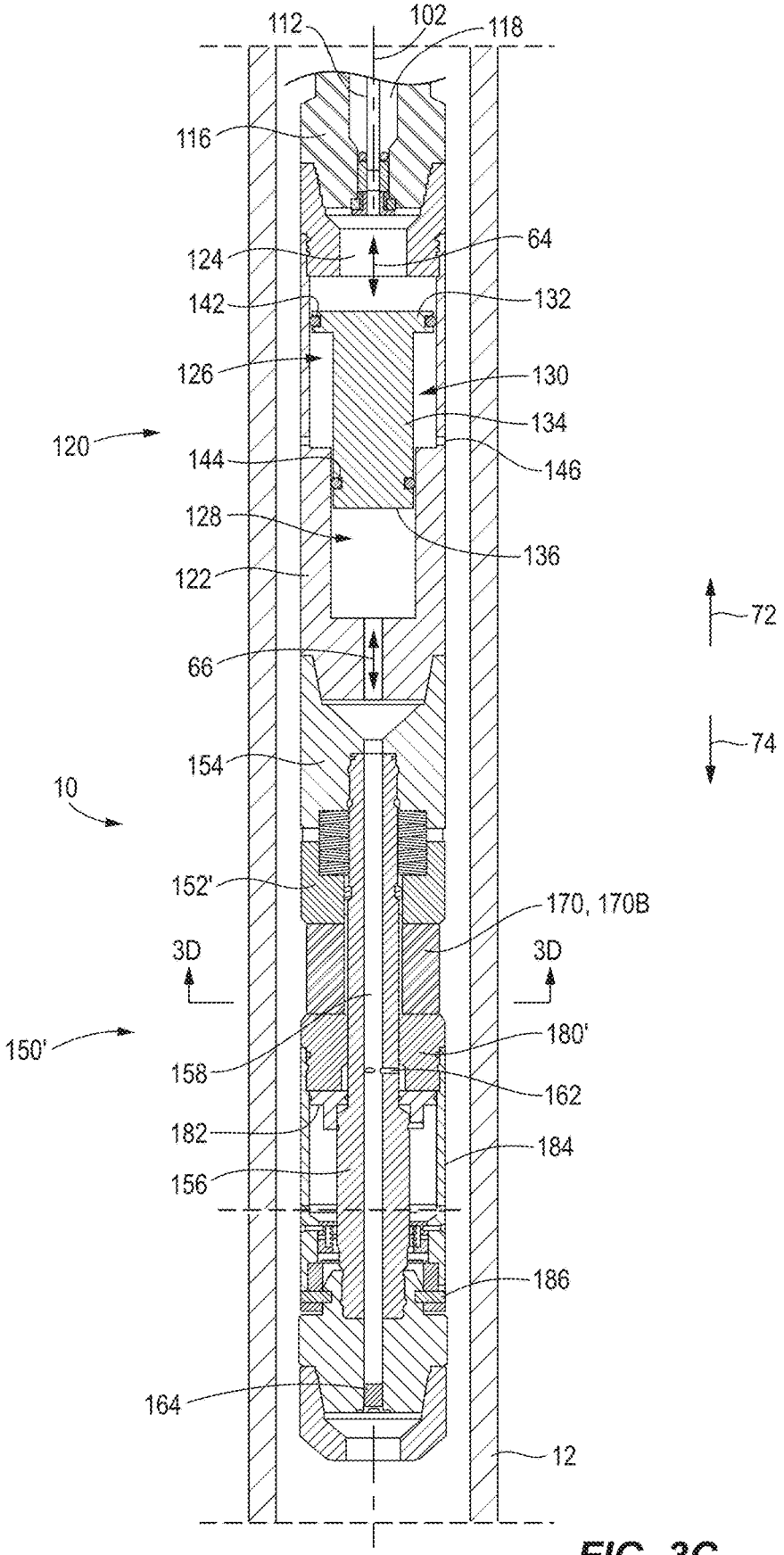
FIG. 3C schematically illustrates details of a portion of the tool assembly of FIG. 1B in a configuration in which the tool assembly is being run into the wellbore.

FIG. 3C schematically illustrates exemplary configurations of the booster sub 120 and anchor 150' of tool assembly 100' in a configuration in which the tool assembly 100' is being run into the wellbore 10. In the illustrated example, the booster sub 120 is configured as described above with respect to FIG. 3A. In the illustrated example, the anchor 150' is configured similarly to anchor 150, except that the anchor 150' is adapted such that the one or more anchor elements 170 include packing element 170B. In some examples, the packing element 170B is made of an elastomeric material.

Figure 3D:
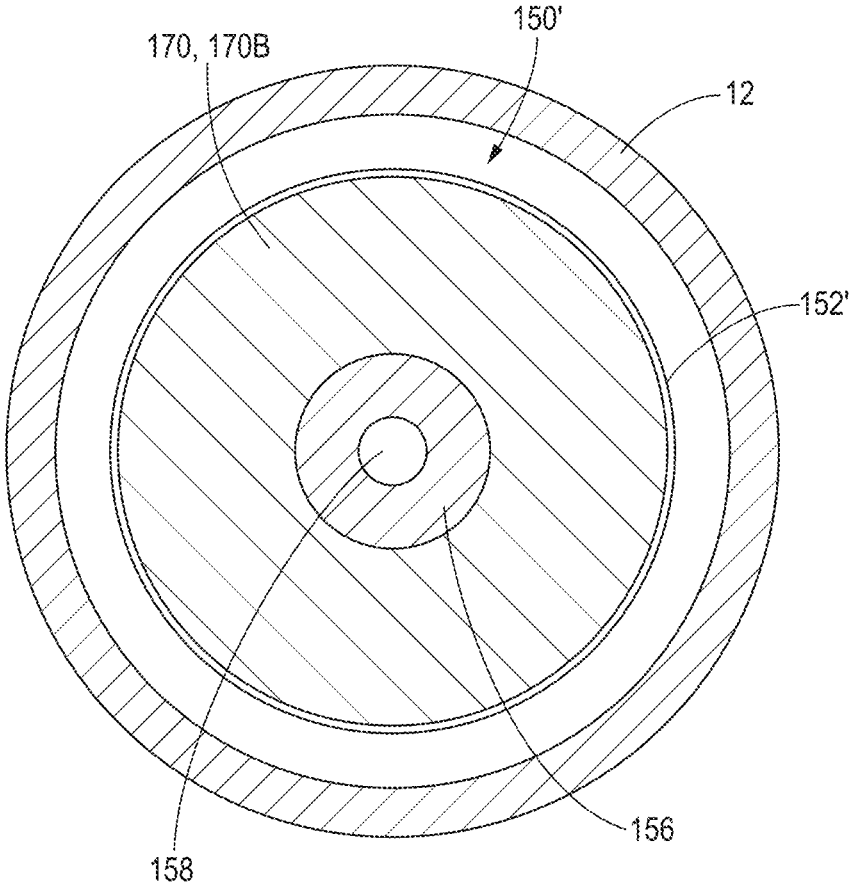
FIG. 3D schematically illustrates a lateral cross-section through one of the tools depicted in FIG. 3C.

Housing 152' is disposed about the mandrel 156. The packing element 170B is disposed in the housing 152 about the mandrel 156. The packing element 170B is illustrated in the retracted position. FIG. 3D schematically illustrates a lateral cross-section through the anchor 150' at the packing element 170B.

Returning to FIG. 3C, as illustrated, in some embodiments, the housing 152' does not include the one or more ramps 174. However, in some embodiments, the housing 152' does include one or more ramps, such as ramps 174. A piston 180' is disposed about the mandrel 156, and is movable longitudinally with respect to the mandrel 156 and with respect to the housing 152'. The piston 180' is disposed adjacent the packing element 170B. The piston 180' is disposed between the packing element 170B and the stop member 182. In some embodiments, the piston 180' is temporarily restrained from moving with respect to the mandrel 156 or with respect to the housing 152', such as described above with respect to piston 180. As illustrated, the one or more frangible fasteners 186 temporarily restrain the piston 180' from moving with respect to the mandrel 156 or with respect to the housing 152'.

In some embodiments, anchor 150' includes a single packing element 170B. In some embodiments, anchor 150' includes a plurality of packing elements 170B. In some embodiments, the packing element 170B does not include an inflatable bladder. In some embodiments, the packing element 170B includes an inflatable bladder. In at least some of such embodiments, the piston 180' may be omitted.

In some embodiments, the booster sub 120 is configured to accommodate thermal expansion of the fluid 66 within the anchor 150' and within the booster sub 120, such as described above with respect to tool assembly 100. In some examples, the piston 130 of the booster sub 120 moves upwards 72 in response to thermal expansion of the fluid 66 while the packing element 170B is in the retracted position shown in FIGS. 3C and 3D.

The setting of the anchor 150' in the wellbore 10 is achieved similarly to the process described above with respect to anchor 150. As described above with respect to anchor 150, piston 180. Upon the one or more frangible fasteners 186 being broken (as described above), the piston 180' is released to move along the mandrel 156.

The piston 180' pushes against the packing element 170B. In some examples, the piston 180' axially compresses the packing element 170B against a shoulder of housing 152'. The packing element 170B expands laterally. In some examples, an inner surface of the packing element 170B is maintained in contact with the mandrel 156 while an outer surface of the packing element 170B moves radially outwardly away from the mandrel 156, the housing 152', and the longitudinal axis 102. The outer surface of the packing element 170B moves radially outwardly away from the mandrel 156, the housing 152, and the longitudinal axis 102 towards an extended position (shown in FIGS. 4C and 4D, below). In some embodiments, the anchor 150' is configured such that the piston 180' moves downwards 74 to cause the outer surface of the packing element 170B to move radially outwardly away from the mandrel 156, the housing 152, and the longitudinal axis 102.

The packing element 170B frictionally engages the casing 12 or an uncased open hole section of the wellbore 10. In some examples in the which the packing element 170B includes an inflatable bladder, the fluid 66 inflates the bladder.

Figure 4A:
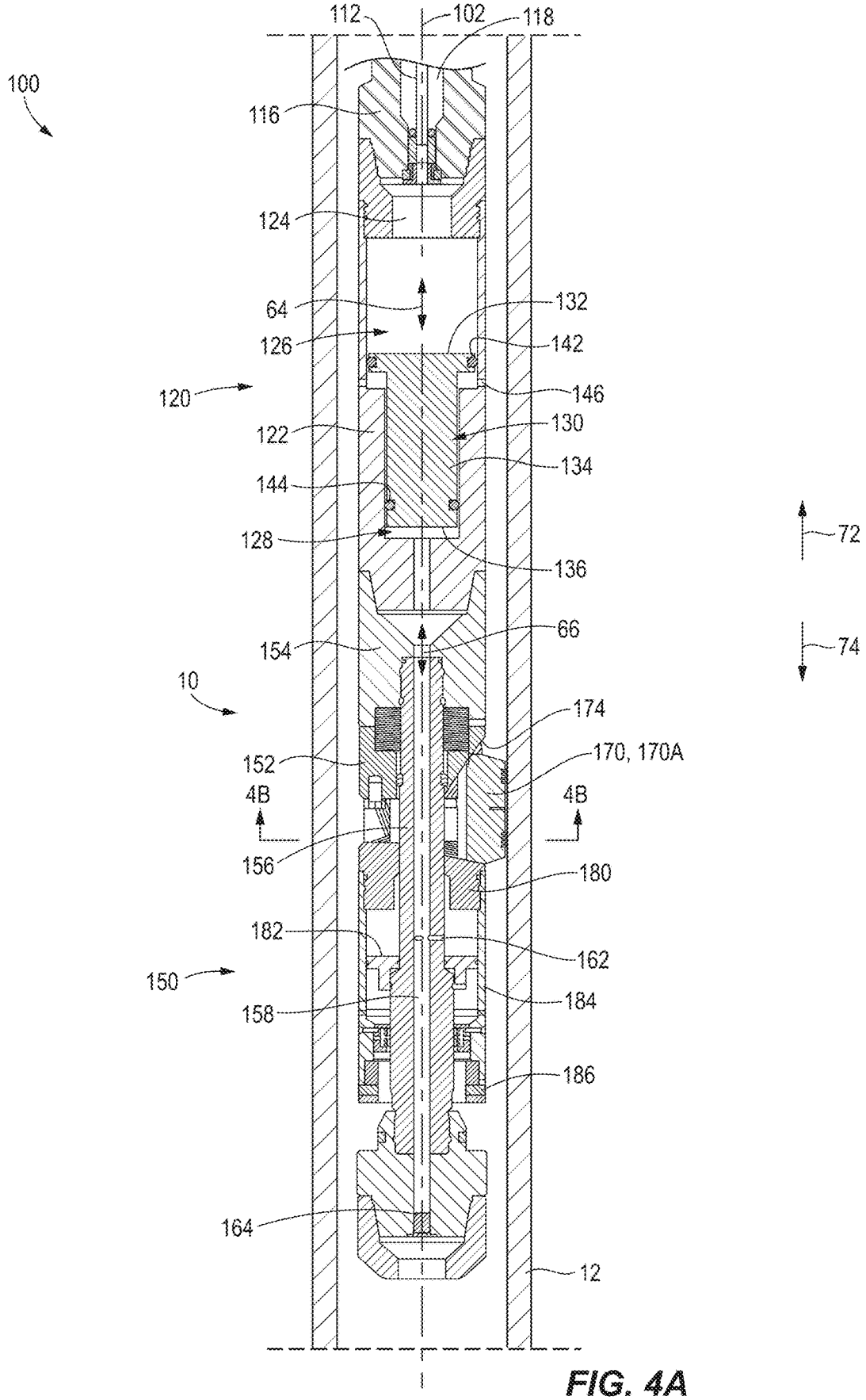
FIG. 4A schematically illustrates details of the portion of the tool assembly shown in FIG. 3A in a configuration in which the tool assembly is set in place in the wellbore.
Figure 4B:
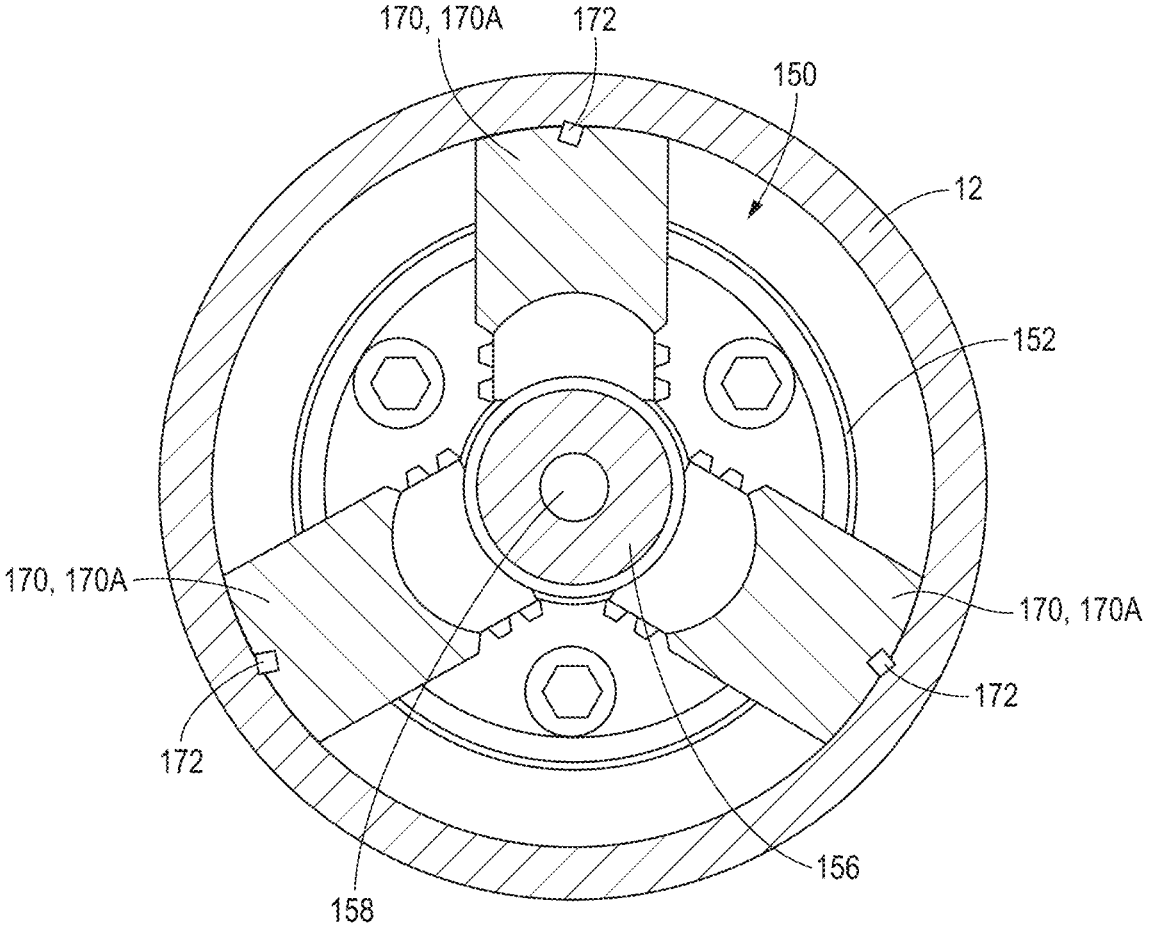
FIG. 4B schematically illustrates a lateral cross-section through one of the tools depicted in FIG. 4A.

FIG. 4A schematically illustrates the booster sub 120 and anchor 150 of tool assembly 100 in a configuration in which the anchor 150 is set in place in the wellbore 10. FIG. 4B schematically illustrates a lateral cross-section through the anchor 150 at the one or more slips 170A. The piston 180 has moved upwards 72 with respect to the housing 152, and each of the one or more slips 170A has moved outwardly away from the mandrel 156, the housing 152, and the longitudinal axis 102. Gripping elements 172, such as teeth or buttons, of each of the one or more slips 170A are at least partially embedded in the casing 12 to grip the casing 12 of the wellbore 10. The piston 130 of the booster sub 120 is shown having moved downwards 74 with respect to the housing 122.

Figure 4C:
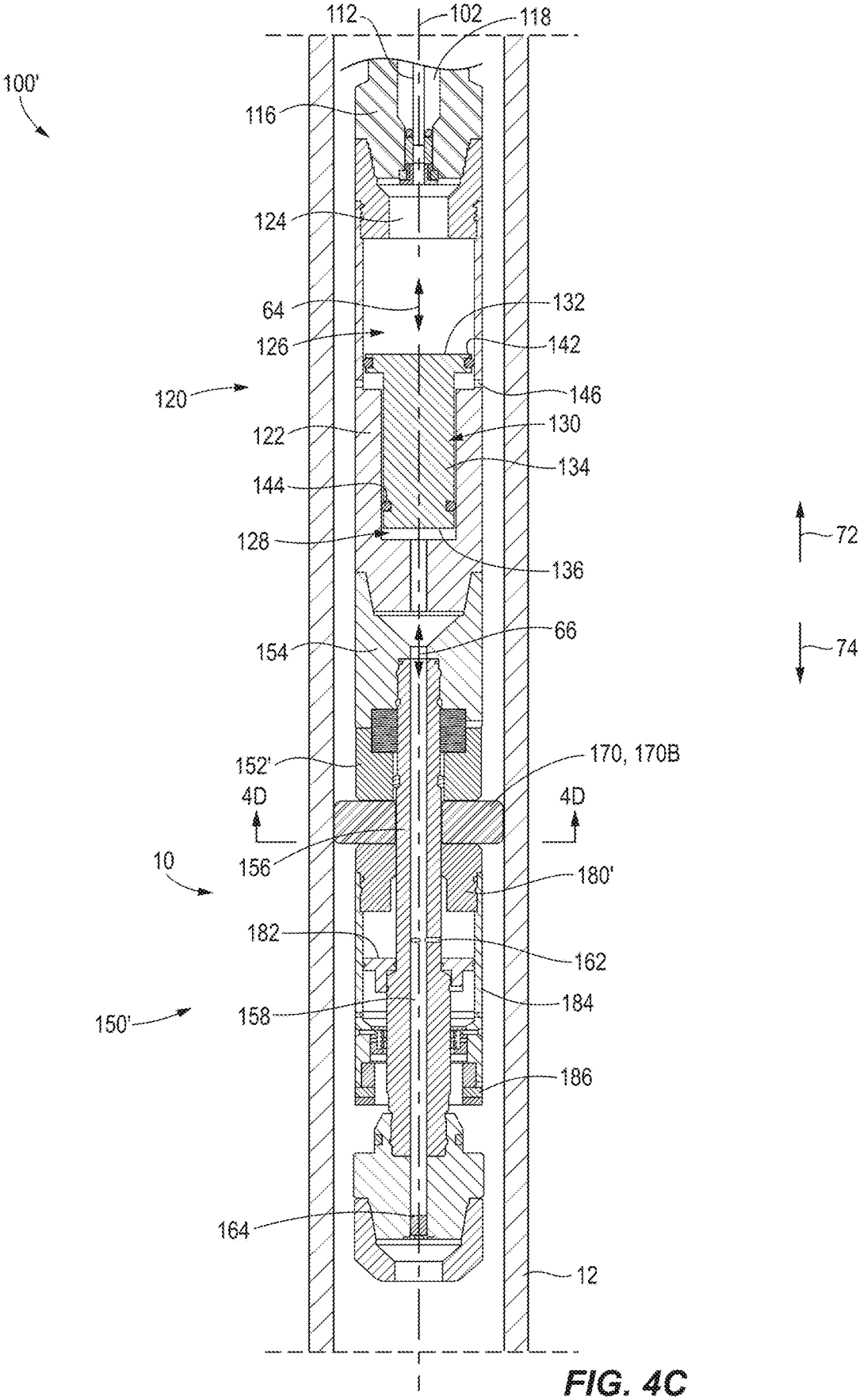
FIG. 4C schematically illustrates details of the portion of the tool assembly shown in FIG. 3C in a configuration in which the tool assembly is set in place in the wellbore.
Figure 4D:
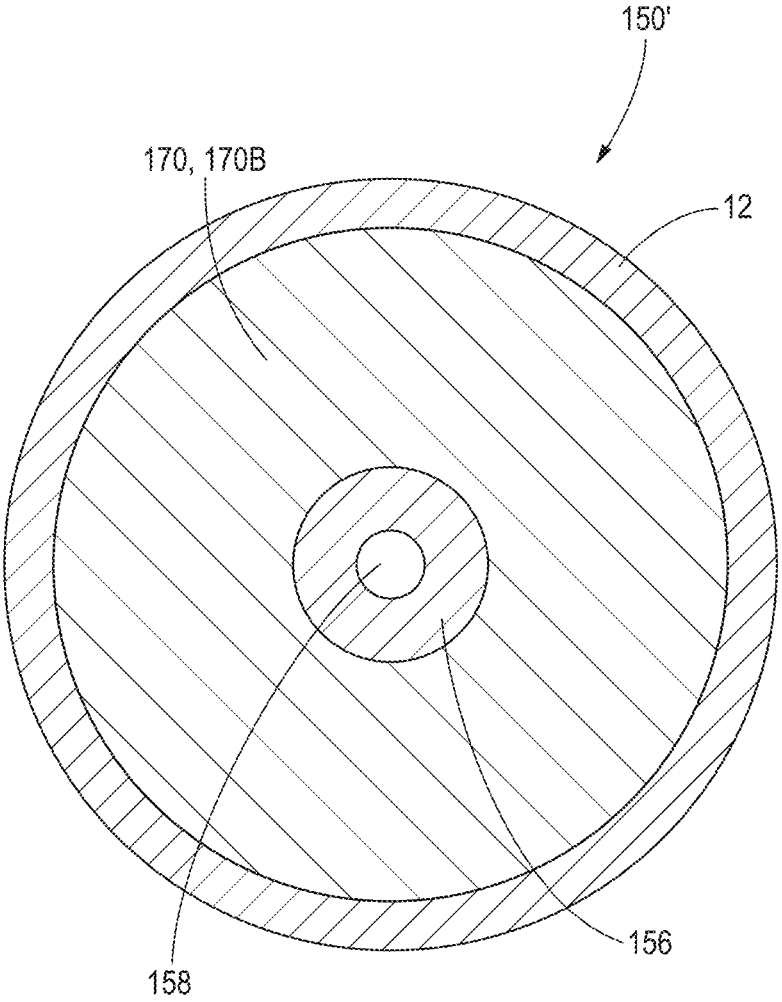
FIG. 4D schematically illustrates a lateral cross-section through one of the tools depicted in FIG. 4C.

FIG. 4C schematically illustrates the booster sub 120 and anchor 150' of tool assembly 100' in a configuration in which the anchor 150' is set in place in the wellbore 10. FIG. 4D schematically illustrates a lateral cross-section through the anchor 150' at the packing element 170B. The piston 180' has moved upwards 72 with respect to the housing 152'. The outer surface of the packing element 170B has moved outwardly away from the mandrel 156, the housing 152', and the longitudinal axis 102 into frictional engagement with the casing 12. The piston 130 of the booster sub 120 is shown having moved downwards 74 with respect to the housing 122.

Figure 5:
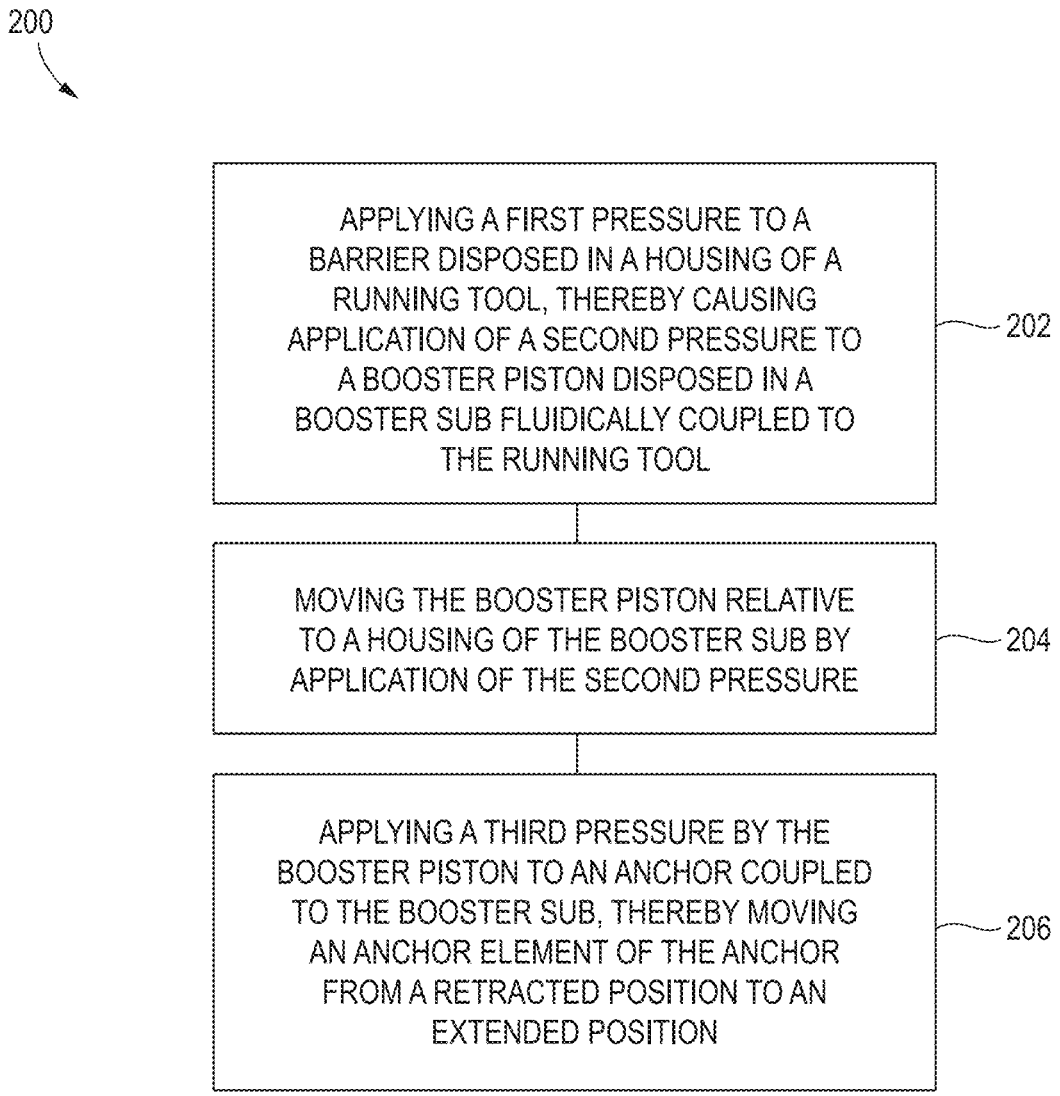
FIG. 5 is a flowchart of a method of performing a downhole operation.

FIG. 5 is a flowchart of a method 200 of performing a downhole operation. The method 200 includes setting an anchor in a wellbore. In some embodiments, the anchor is (or is configured similarly to) anchor 150. In some embodiments, the anchor is (or is configured similarly to) anchor 150'.

Operation 202 includes applying a first pressure to a barrier disposed in a housing of a running tool (such as running tool 30), thereby causing application of a second pressure to a booster piston disposed in a booster sub (such as booster sub 120) that is fluidically coupled to the running tool In some embodiments, the barrier is barrier 40. In some embodiments, the barrier includes a piston, such as piston 40A, and application of the first pressure moves the piston. In some embodiments, the barrier includes a rupture disc, such as rupture disc 40B, and application of the first pressure causes the rupture disc to fail. In some embodiments, the barrier includes a valve, such as valve 40C, and application of the first pressure causes the valve to open.

Operation 204 includes moving the booster piston relative to a housing of the booster sub by application of the second pressure. In some embodiments, the booster piston is piston 130, and the second pressure is applied to the piston head 132 of the piston 130. In some embodiments, the booster piston moves downwards parallel to a longitudinal axis of the booster sub.

Operation 206 includes applying a third pressure by the booster piston to an anchor coupled to the booster sub, thereby moving an anchor element of the anchor from a retracted position to an extended position. In some embodiments, the anchor element is anchor element 170. In some embodiments, the anchor element includes one or more slips, such as one or more slips 170A. In some embodiments the anchor element includes one or more packing elements, such as packing element 170B.

In some embodiments, the third pressure is greater than the second pressure. In some examples, the third pressure is applied by a piston rod (such as piston rod 134) of the booster piston. In some embodiments, the third pressure is greater than the first pressure. In some embodiments, the first pressure is less than or equal to a prescribed operating pressure of the running tool or of another tool that is coupled to the running tool. In some embodiments, the third pressure is greater than or equal to a prescribed operating pressure of the running tool or of another tool that is coupled to the running tool. In some embodiments, the first pressure is less than or equal to a prescribed maximum internal pressure of the running tool or of another tool that is coupled to the running tool. In some embodiments, the third pressure is greater than or equal to a prescribed maximum internal pressure of the running tool or of another tool that is coupled to the running tool.

In some embodiments, operation 206 includes applying the third pressure to a piston (such as piston 180 or piston 180') of the anchor. In some embodiments, operation 206 includes moving the piston of the anchor, thereby moving the anchor element of the anchor from the retracted position to the extended position. In some embodiments, the booster piston moves in a first direction, and the piston of the anchor moves in the first direction. In some embodiments, the booster piston moves in a first direction, and the piston of the anchor moves in a second direction opposite the first direction.

In some embodiments, the anchor element engages a casing (such as casing 12) of the wellbore when in the extended position. In some embodiments, the anchor element frictionally engages the casing. In some embodiments, a gripping element (such as gripping element 172) of the anchor element at least partially embeds in the casing to grip the casing. In some embodiments, the anchor element engages an open hole section of the wellbore when in the extended position. In some embodiments, the anchor element frictionally engages the open hole section of the wellbore. In some embodiments, a gripping element (such as gripping element 172) of the anchor element at least partially embeds in the open hole section of the wellbore.

In some embodiments, the method 200 includes compensating for thermal expansion of fluid in the anchor. In some examples, the compensating is performed prior to operation 202. In some embodiments, the compensating includes moving the booster piston in a first direction to compensate for thermal expansion of fluid in the anchor, and then, during operation 204, moving the booster piston in a second direction opposite the first direction.

In some embodiments, the method 200 includes orienting a whipstock, such as whipstock 110, in the wellbore. In some embodiments, orienting the whipstock includes positioning a face of a deflector plate (such as deflector plate 114) at a predetermined azimuth in the wellbore. In some embodiments, orienting the whipstock is performed before setting the anchor in the wellbore.

In some embodiments, the method 200 includes releasing a running string (such as running string 20) from the anchor. In some examples, releasing the running string from the anchor includes releasing the running string from the whipstock. In some examples, releasing the running string from the whipstock includes shearing a connecting bolt, such as bolt 22. In some examples, releasing the running string from the whipstock includes retracting a connecting bolt, such as bolt 22.

In some embodiments, the method 200 includes milling a window in the casing. In some embodiments, milling the window in the casing includes using the bit 60 configured as a mill or a mill-drill bit to mill the window.

In some embodiments, the method 200 includes drilling a bore into a rock formation adjacent the whipstock. In some embodiments, drilling the bore includes using the bit 60 configured as a drill bit or a mill-drill bit to drill the bore into the rock formation adjacent the whipstock. In some embodiments, drilling the bore includes using a drilling assembly, such as drilling assembly 80.

In some embodiments, the method 200 includes adjusting a direction of drilling the bore into the rock formation. In some embodiments, adjusting a direction of drilling the bore includes using the drilling assembly (such as drilling assembly 80) to adjust the direction. In some examples, the drilling assembly is configured as a directional drilling assembly. In some examples, the drilling assembly is configured as a rotary steerable drilling system.

In some embodiments, the method 200 includes one or more of the actions or operations of the present disclosure.

In some embodiments, the method 200 is performed using the tool assembly 100. In some embodiments, the method 200 is performed using the tool assembly 100'. In some embodiments, the method 200 is performed using the running string 20.

Figure 6:
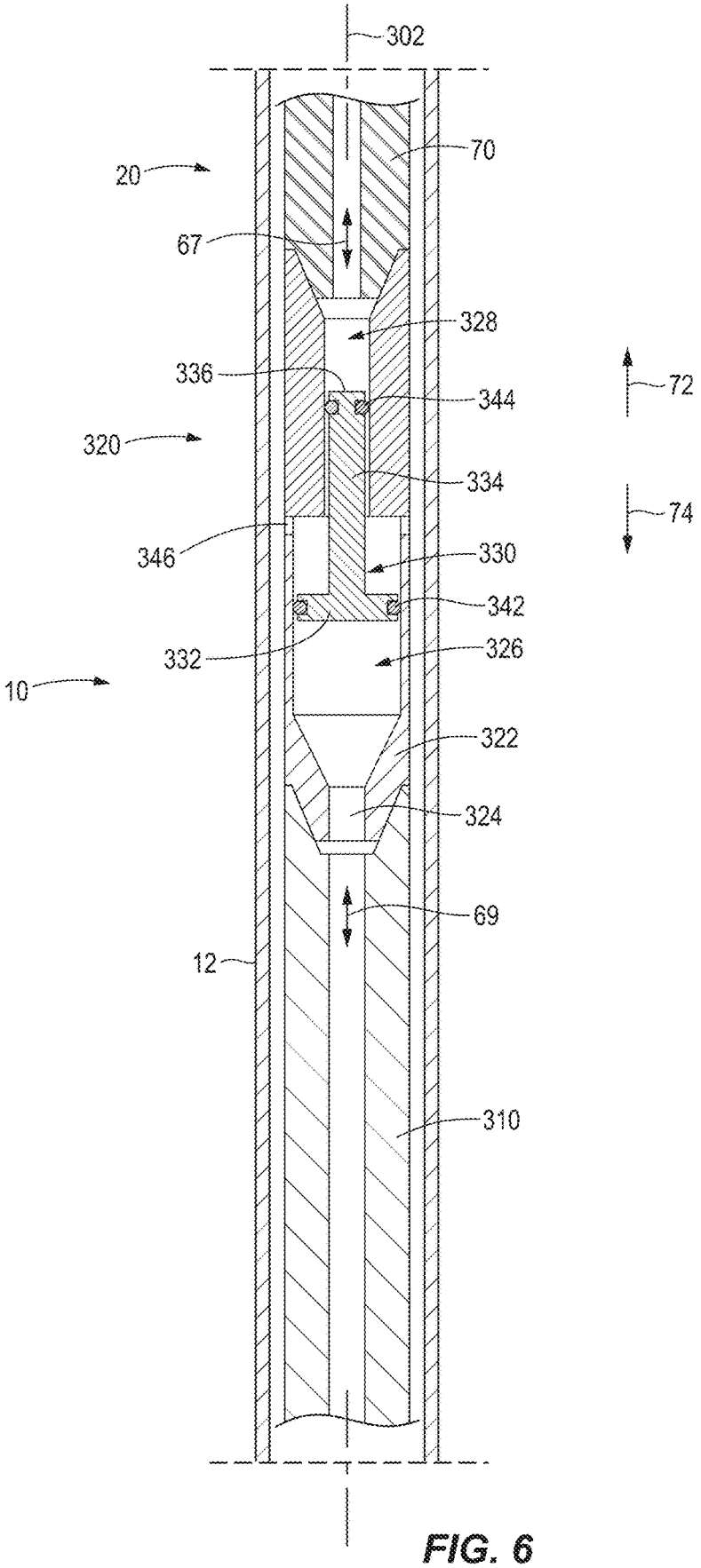
FIG. 6 schematically illustrates a tool assembly in a wellbore.

FIG. 6 schematically illustrates a tool assembly 300 in the wellbore 10. The tool assembly 300 is coupled to a component (such as tubular 70) of the running string 20. The tool assembly 300 includes a pressure sub 320 coupled to a downhole tool 310. In some embodiments, the downhole tool 310 is an anchor (such as anchor 150 or 150') or packer. In some embodiments, the downhole tool 310 is a drilling tool, such as a logging tool (e.g., a Measurement While Drilling tool or a Logging While Drilling tool) or a directional drilling tool. Exemplary directional drilling tools include orientation tools, such as an adjustable stabilizer. In some examples, the downhole tool 310 is a component of a drilling system, such as drilling system 80. In some embodiments, the downhole tool 310 has an operational pressure less than a maximum operating pressure of the pressure sub 320. In some embodiments, the downhole tool 310 has an internal pressure rating less than a maximum operating pressure of the pressure sub 320.

The pressure sub 320 includes a housing 322 with a bore 324 therethrough. The bore 324 runs longitudinally (e.g., along a longitudinal axis 302) through the housing 322. A piston 330 is disposed in the bore 324, and is movable longitudinally with respect to the housing 322. In some embodiments, the piston 330 is configured as a floating piston, and is able to move upwards 72 and downwards 74.

The piston 330 includes a piston head 332 coupled to a piston rod 334. The piston head 332 has an outer diameter that is greater than an outer diameter of the piston rod 334. The piston head 332 is disposed in a first portion 326 of the bore 324 having a first inner diameter, and includes a seal 342 in contact with a wall of the first portion 326 of the bore 324. The piston rod 334 is disposed in a second portion 328 of the bore 324 having a second inner diameter. The second inner diameter is smaller than the first inner diameter. The piston rod 334 includes a seal 344 in contact with a wall of the second portion 328 of the bore 324. The seal 344 is disposed proximal to an end 336 of the piston rod 334, distal from the piston head 332.

A cross-sectional area of the first portion 326 of the bore 324 is larger than a cross-sectional area of the second portion 328 of the bore 324. A cross-sectional area of the piston head 332 is larger than a cross-sectional area of the piston rod 334.

The piston 330 isolates a fluid (represented by double-headed arrow 67) in the housing 322 above the end of the piston rod 334 from a fluid (represented by double-headed arrow 69) in the housing 322 below the piston head 332. In some embodiments, the fluid 67 and the fluid 69 have the same composition. In other embodiments, the fluid 67 and the fluid 69 are of different compositions. In some examples, the fluid 67 includes one of a brine or a hydraulic oil, whereas the fluid 69 includes the other of a brine or a hydraulic oil. In other examples, the fluid 67 includes a first brine (such as a formate brine), whereas the fluid 69 includes a second brine (such as a chloride brine). In other examples, the fluid 67 includes a first hydraulic oil, whereas the fluid 69 includes a second hydraulic oil of a composition different to the first hydraulic oil.

The piston 330 is configured such that there is no fluid communication through the piston 330 between the fluid 67 above the piston rod 334 and the fluid 69 below the piston head 332. As illustrated, in some embodiments, the piston 330 does not include a bore through the piston head 332 and the piston rod 334. In some embodiments, the piston 330 includes a bore through the piston head 332 and the piston rod 334. In some examples, the bore through the piston head 332 and the piston rod 334 is plugged, such as by a plug or stopper, or by a valve (such as a check valve, poppet valve, or metering valve).

One or more vents 346 in the housing 322 fluidically couple the bore 324 with an exterior of the housing 322. The one or more vents 346 are located between the piston head 332 and the seal 344 of the piston rod 334. As illustrated, in some embodiments, the one or more vents 346 intersect with the first portion 326 of the bore 324. In some embodiments, the one or more vents 346 intersect with the second portion 328 of the bore 324. The one or more vents 346 relieve a potential pressure lock in the bore 324 between the seal 342 of the piston head 332 and the seal 344 of the piston rod 334.

In some embodiments, the pressure sub 320 is configured to accommodate thermal expansion of the fluid 69 within the downhole tool 310 and within the pressure sub 320. In some examples, the piston 330 of the pressure sub 320 is configured as a floating piston, and moves upwards 72 in response to thermal expansion of the fluid 69.

The pressure sub 320 can be used to mitigate the effect on the downhole tool 310 from pressures developed in the running string 20. An increase in pressure applied to the piston rod 334 via the fluid 67 results in a proportionally lower increase in pressure applied by the piston head 332 to the fluid 69. The increased pressure of the fluid 67 is communicated via the running string 20 to the pressure sub 320. The pressure of the fluid 67 acts on the piston rod 334 of the piston 330. The piston 330 communicates pressure to the fluid 69 via the piston head 332. The pressure applied to the piston rod 334 by the fluid 67 is greater than the pressure exerted by the piston head 332 on the fluid 69. The lower pressure applied by the piston head 332 to the fluid 69 results from the larger cross-sectional area of the first portion 326 of the bore 324 containing the piston head 332 compared to the cross-sectional area of the second portion 328 of the bore 324 containing the piston rod 334.

In some embodiments one or more elements of the tool assembly 100 are deployed together with one or more elements of the tool assembly 300. In some examples, an assembly includes the booster sub 120 and the pressure sub 320.

The systems, apparatus, and methods of the present disclosure facilitate operating one or more tools in a wellbore by applying a pressure, while mitigating the magnitude of pressure to which one or more other tools in the wellbore are exposed. In some example operations, a pressure increase is applied through a running string to a plurality of tools in a wellbore. In some embodiments, a tool located at a first depth in the wellbore experiences a lower pressure increase than a pressure increase experienced by a tool located at a deeper second depth in the wellbore. In some embodiments, a tool located at a first depth in the wellbore experiences a greater pressure increase than a pressure increase experienced by a tool located at a deeper second depth in the wellbore.

The systems, apparatus, and methods of the present disclosure facilitate the compensation of thermal expansion of a fluid in tool in a wellbore by using a piston that is also used to cause operation of the tool.

It is contemplated that any one or more elements or features of any one disclosed embodiment or example may be beneficially incorporated in any one or more other non-mutually exclusive embodiments or examples. While the foregoing is directed to embodiments of the present disclosure, other and further embodiments of the disclosure may be devised without departing from the basic scope thereof, and the scope thereof is determined by the claims that follow.

What is claimed is:

1. An assembly for use with a downhole tool, the assembly comprising:

an anchor comprising:

a first housing;

an anchor element coupled to the first housing, and movable with respect to the first housing between a retracted position and an extended position;

a first piston that is coupled to the first housing; and a booster sub coupled to the anchor, the booster sub comprising:

a second housing;

a second piston disposed in the second housing, the second piston isolating a first fluid in the anchor from a second fluid in the booster sub, and the second piston including a first seal and a second seal spaced from the first seal; and a vent in the second housing that is positioned between the first seal and the second seal, wherein when the anchor element is in the retracted position, the second piston is movable relative to the second housing in a first direction and in an opposite second direction, and wherein movement of the second piston in the first direction is configured to move the first piston in the second direction to move the anchor element from the retracted position to the extended position.

2. The assembly of claim 1, wherein:

the second piston includes:

a piston head having a first outer diameter; and a piston rod coupled to the piston head, and having a second outer diameter less than the first outer diameter;

the piston head is sealingly engaged with a first portion of the second housing via the first seal; and the piston rod is sealingly engaged with a second portion of the second housing via the second seal.

3. The assembly of claim 1, wherein the anchor element is a slip.

4. The assembly of claim 3, wherein the anchor element is a packing element.

5. The assembly of claim 4, wherein the packing element is inflatable.

6. An assembly comprising:

an anchor comprising:

a first housing containing a first fluid;

an anchor element coupled to the first housing, and movable with respect to the first housing between a retracted position and an extended position; and a first piston that is coupled to the first housing and that is configured to move the anchor element from the retracted position to the extended position;

a booster sub coupled to the anchor, the booster sub comprising:

a second housing containing a second fluid; and a second piston disposed in the second housing, and including a pair of seals that are configured to isolate isolating the second fluid from the first fluid, wherein movement of the second piston is configured to cause movement of the first piston; and a vent in the second housing that is positioned between the pair of seals to prevent pressure lock between the pair of seals;

a whipstock coupled to the booster sub, the whipstock including a hydraulic line containing the second fluid and fluidically coupled to the booster sub; and a running tool coupled to the whipstock, the running tool fluidically coupled to the hydraulic line, and comprising:

a third housing containing a third fluid; and a barrier disposed in the third housing, the barrier separating the third fluid from the second fluid.

7. The assembly of claim 6, wherein the barrier is operable from a first configuration in which the second fluid is isolated from the third fluid, and a second configuration in which commingling of the third fluid and the second fluid is permitted.

8. The assembly of claim 7, wherein the barrier includes one of a rupture disc or a valve.

9. The assembly of claim 6, wherein when the anchor element is in the retracted position, the second piston is movable relative to the second housing in a first direction and in an opposite second direction.

10. The assembly of claim 9, wherein:

movement of the second piston in the first direction does not cause movement of the anchor element; and movement of the second piston in the second direction causes movement of the anchor element from the retracted position to the extended position.

11. The assembly of claim 9, wherein the barrier includes a barrier piston movable relative to the third housing in the first direction and in the second direction.

12. The assembly of claim 6, wherein the anchor element is a slip or a packing element.

13. The assembly of claim 6, wherein the third fluid is different from the first and second fluids.

14. The assembly of claim 6, wherein the second fluid is different from the first fluid.

15. A method of performing a downhole operation by use of the assembly of claim 6, the method comprising:

applying a first pressure to the barrier, thereby causing application of a second pressure to the second piston;

moving the second piston relative to the third housing by application of the second pressure; and applying a third pressure by the second piston to the anchor, thereby moving the anchor element from a retracted position to an extended position.

16. The method of claim 15, wherein the third pressure is greater than the second pressure;

wherein moving the second piston comprises moving the second piston in a first direction, and wherein the method further comprises:

moving the first piston in a second direction by application of the third pressure by the second piston, the second direction being opposite the first direction; and moving the anchor element from the retracted position to the extended position by the moving of the first piston in the second direction.

17. The method of claim 15, wherein:

the barrier includes a barrier piston; and application of the first pressure moves the barrier piston.

18. The method of claim 15, wherein:

the barrier includes one of a rupture disc or a valve; and application of the second pressure to the second piston includes flowing a fluid through the barrier.

19. The method of claim 15, wherein the anchor element is a slip or a packing element.

* * * * *